350-268 SR
5/24/83 XR 4,385,284

United States Patent [19]

Gould et al.

[11] 4,385,284

[45] May 24, 1983

[54] VISOR ASSEMBLY FOR PEDESTRIAN TRAFFIC SIGNAL

[75] Inventors: Samuel Gould, San Pedro; James S. Gould, Los Angeles, both of Calif.

[73] Assignee: Indicator Controls Corporation, Gardena, Calif.

[21] Appl. No.: 270,589

[22] Filed: Jun. 4, 1981

[51] Int. Cl.[3] ..... E01F 9/00; F21V 17/00

[52] U.S. Cl. ..... 340/119; 340/44; 340/87; 340/815.32; 40/554; 40/577; 116/63 R; 362/186; 362/376; 362/358; 362/359; 350/268; 350/276 R

[58] Field of Search ..... 340/119, 107-110, 340/84, 87, 90, 103, 50, 114 R, 114 B, 41 A, 44-46, 122-124, 815.32, 815.33; 40/554, 573, 574, 577, 578, 579, 612; 350/268, 276 R, 276 SL; 116/63 R, 63 P; 362/185, 186, 190, 358, 359, 376, 382, 290-292

[56] References Cited

U.S. PATENT DOCUMENTS 3,863,251 1/1975 Gould et al. ..... 362/290

4,240,063 12/1980 Gould et al. ..... 340/119

*Primary Examiner*—Donnie L. Crosland

*Attorney, Agent, or Firm*—Keith D. Beecher

[57] ABSTRACT

A visor assembly for a pedestrian traffic signal, which is intended to be mounted across the face of the signal and which serves to screen the signal from sunlight. The visor assembly includes a frame, and an "egg-crate" grating mounted in the frame, the grating being composed of a multiplicity of intersecting webs which provide a plurality of rectangular openings. The invention, the grating is locked in the frame to prevent vandalism by plastic strips which receive the ends of the webs, and which are secured to the frame.

3 Claims, 3 Drawing Figures

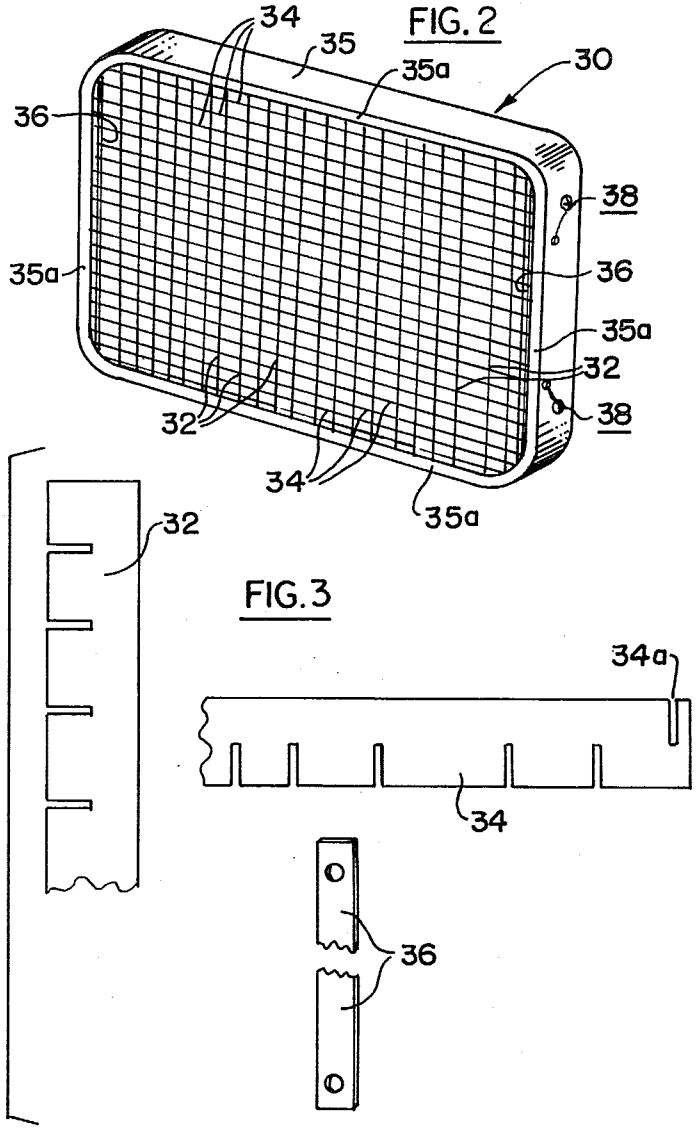
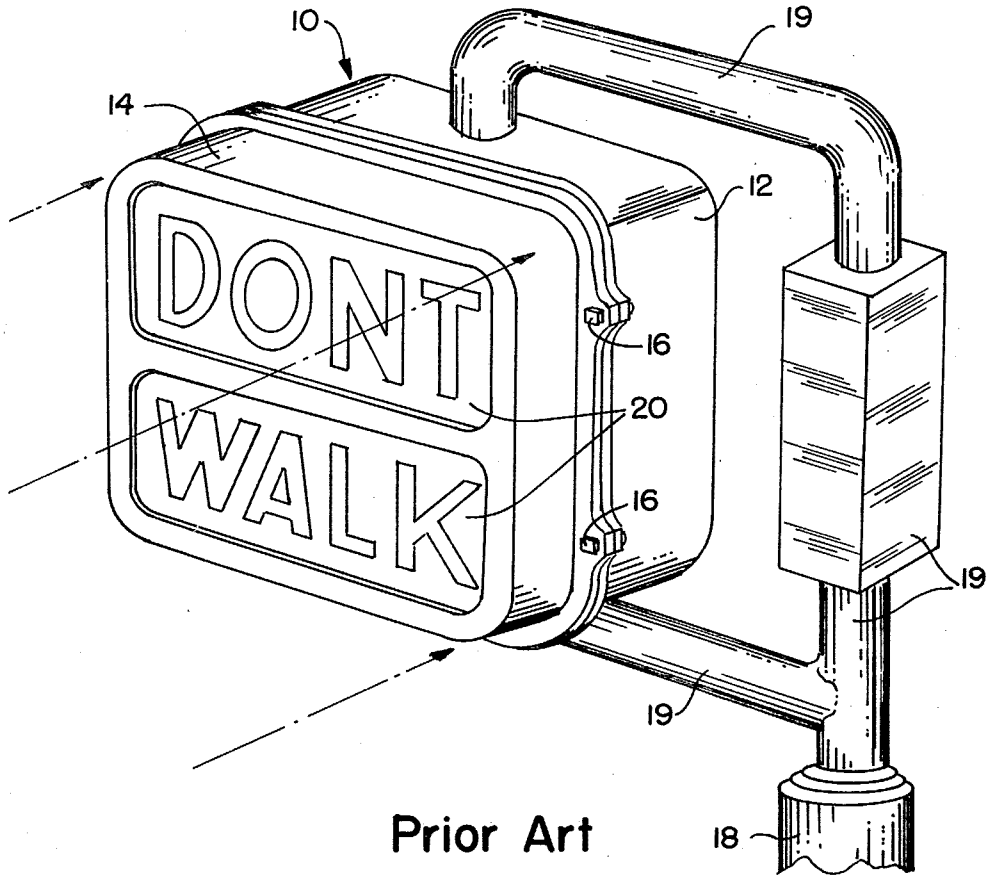
Prior Art

VISOR ASSEMBLY FOR PEDESTRIAN TRAFFIC SIGNAL

BACKGROUND

A visor assembly of the present invention is of the general type described, for example, in U.S. Pat. No. 3,863,251 which issued Jan. 28, 1975, and which is assigned to the present Assignee. It has been found that visor assemblies of the type described in the patent are subject to widespread vandalism, the vandalism involving twisting and pulling the egg-crate grating out of the frame. Many attempts have been made in the past to render the visor assemblies proof against such vandalism, one such attempt being dislosed in U.S. Pat. No. 4,240,063 which issued Dec. 16, 1980, and which also is assigned to the present assignee. However, these attempts have only been partially successful.

Accordingly, the principal objective of the present invention is to provide such a visor assembly which is virtually proof from vandalism, and yet which may be constructed and assembled with relative ease and simplicity.

RELATED COPENDING APPLICATION

Ser. No. 305,452, filed Sept. 25, 1981 in the name of the present inventors and assigned to the present assignee.

BRIEF DESCRIPTION OF THE DRAWING

FIG. 1 is a perspective representation of a typical prior art pedestrian traffic control signal.

FIG. 2 is a perspective representation of a visor constructed in accordance with the concepts of the present invention to be mounted over the face of the control signal of FIG. 1; and FIG. 3 is a series of elevational views of the webs and locking strips used in the assembly of FIG. 1, to prevent the visor assembly from being vandalized.

DETAILED DESCRIPTION OF THE ILLUSTRATED EMBODIMENT

The pedestrian traffic control signal illustrated in FIG. 1 of the accompanying drawing is designated generally as 10. The signal includes a usual housing 12 and a cover 14, the cover being hinged to the housing. The cover may be opened to permit access to the interior of the housing. The cover may be held closed over the front of the housing by means, for example, of bolts 16, or other appropriate fasteners. The pedestrian traffic signal 10 is supported on a usual standard 18 by means of a bracket 19.

As is well known, approximate light sources are mounted within the housing 12, and these sources are selectively energized so as to illuminate the legend "WALK" on the lower portion of face plate 20, or both the legends "DONT" and "WALK" on the upper and lower portions of the face plate.

As fully described in U.S. Pat. No. 3,863,251, referred to above, a visor 30 such as shown in FIG. 2 is mounted in front of the face plate 20 of the signal which bears the legends "DONT' and "WALK". The visor 30 contains a grating which is formed by a first set of webs 32 which intersect with a second set of webs 34 to define a plurality of rectangular openings. These webs serve to blank out the legends "DONT" and "WALK" when the corresponding light sources within the signal are de-energized, this being achieved by minimizing reflections on the external surface of the screen 20, even in the presence of strong incident sunlight.

The webs 32, 34 of visor 30 are surrounded by a frame 35. In order to maintain the webs 32, 34 within frame 35, and to preclude vandals from forcing the webs out of the frame, a pair of locking strips 36 (FIG. 3) are positioned at each side of the frame, as shown in FIG. 2, and are secured to the frame by rivets, such as revets 38. The locking strips are received in slots, such as slots 34*a* (FIG. 3) at the ends of webs 34.

The resulting assembly is one in which the grating formed by webs 32 and 34 is firmly retained within the frame 35, and the entire assembly is relatively proof against vadalism.

Although a particular embodiment of the invention has been shown and described, modifications may be made. It is intended in the claims to cover the modifications which come within the true spirit and scope of the invention.

What is claimed is:

1. In combination with a pedestrian traffic signal of the type having legends selectively illuminated by light sources within the housing of the signal, a grating mounted on the housing in front of the legends composed of a first set of webs and a second set of webs which intersect with one another to form a multiplicity of intersecting webs providing a plurality of openings through which the legends are exposed when illuminated by the light sources within the housing; a frame extending around and supporting said webs, said frame having a rim portion extending inwardly from the perimeter of the frame in coplanar relationship with the front of the frame for receiving the ends of the webs; and at least one locking strip secured to a side of said frame extending across the ends of one set of said webs to prevent said webs from being forced out of said frame.

2. The combination defined in claim 1, in which the ends of said one set of webs are slotted to receive the locking strip.

3. The combination defined in claim 1, and which includes two of said locking strips secured to opposite sides of said frame.

* * * * *